US011964797B1

(12) United States Patent
Burns, Jr. et al.

(10) Patent No.: US 11,964,797 B1
(45) Date of Patent: Apr. 23, 2024

(54) LIQUID CONTAINERS, FILTERS, CAPS, HOSE ASSEMBLIES AND KITS

(71) Applicant: Turn 3 Holdings LLC, Amarillo, TX (US)

(72) Inventors: Andrew Stephen Burns, Jr., Tavernier, FL (US); Michael Thomas Benson, New Lebanon, NY (US)

(73) Assignee: Turn 3 Holdings LLC, Amarillo, TX (US)

( * ) Notice: Subject to any disclaimer, the term of this patent is extended or adjusted under 35 U.S.C. 154(b) by 0 days.

(21) Appl. No.: 18/195,280

(22) Filed: May 9, 2023

(51) Int. Cl.
*B65D 25/48* (2006.01)
*B65D 25/28* (2006.01)
*B65D 47/12* (2006.01)

(52) U.S. Cl.
CPC ..... *B65D 25/48* (2013.01); *B65D 47/121* (2013.01); *B65D 47/123* (2013.01); *B65D 25/2894* (2013.01); *B65D 2205/02* (2013.01)

(58) Field of Classification Search
CPC ..... B65D 25/48
See application file for complete search history.

(56) References Cited

U.S. PATENT DOCUMENTS 596,369 A * 12/1897 Jackson ..... A47J 31/14 210/466
2,556,627 A 6/1951 Miksis
4,583,668 A * 4/1986 Maynard, Jr. ..... B65D 25/48 215/390
D301,689 S 6/1989 Fick et al.
D305,982 S 2/1990 Gillispie et al.
5,076,333 A * 12/1991 Law ..... B67D 3/046 141/335
D338,158 S 8/1993 Poirier
D340,640 S 10/1993 Ferguson et al.
5,249,611 A * 10/1993 Law ..... B67D 3/046 141/335
D346,113 S 4/1994 Ferguson et al.
(Continued)

FOREIGN PATENT DOCUMENTS

CN 302241160 12/2012
CN 307000366 12/2021
IN 256185-001 3/2014

OTHER PUBLICATIONS

Polisport 20L Pro Octane Rapid Fuel Can, https://www.wscperformance.co.uk/products/polisport-201-pro-octane-rapid-fuel-can, webpage accessed on Feb. 22, 2023 (2 pages).
(Continued)

*Primary Examiner* — Jeremy Carroll
(74) *Attorney, Agent, or Firm* — Pizarro Allen PC

(57) ABSTRACT

A container may include a generally hollow body configured for holding a liquid and including a spout. A spout cap may be configured for removable engagement with the spout. The spout cap may include an inner boss and an outer boss in fluid communication with the inner boss. The inner boss may include an annular skirt disposed within an interior space of the spout cap. The outer boss may be configured to receive a connector of a hose assembly. A filter may have a connecting portion configured for removable insertion into the inner boss. The filter and the spout cap may form a fluid flow path from the body through the spout. Related filters, hose assemblies, and kits are also described.

14 Claims, 15 Drawing Sheets

(56) References Cited

U.S. PATENT DOCUMENTS

| | | | | |
|---|---|---|---|---|
| D358,330 | S | 5/1995 | Kahl | |
| 5,472,025 | A | 12/1995 | Conrad et al. | |
| 6,006,961 | A | 12/1999 | Wark | |
| D433,635 | S | 11/2000 | Chrisco et al. | |
| D434,328 | S | 11/2000 | Chrisco et al. | |
| D477,224 | S | 7/2003 | Hussain | |
| D482,967 | S | 12/2003 | Bourque et al. | |
| D516,434 | S | 3/2006 | McGuire | |
| D526,203 | S | 8/2006 | Mishra | |
| D528,423 | S | 9/2006 | Glover | |
| D534,796 | S | 1/2007 | Falkenburg | |
| D542,655 | S | 5/2007 | Szczesniak | |
| 7,240,809 | B2 | 7/2007 | Godfrey | |
| 7,416,087 | B2 | 8/2008 | Press | |
| D581,481 | S | 11/2008 | Edwards | |
| D636,056 | S | 4/2011 | Pritchard | |
| D654,796 | S | 2/2012 | Wurth et al. | |
| D685,452 | S | 7/2013 | Turner | |
| D732,393 | S | 6/2015 | Senus | |
| D743,264 | S | 11/2015 | Mariani | |
| D760,345 | S | 6/2016 | Campbell et al. | |
| D760,869 | S | 7/2016 | Sanders | |
| D763,696 | S | 8/2016 | Eisen | |
| D782,321 | S | 3/2017 | Ihorovych | |
| D815,943 | S | 4/2018 | Candelaria | |
| D866,338 | S | 11/2019 | Eisen | |
| D919,436 | S | 5/2021 | Currie et al. | |
| D935,322 | S | 11/2021 | Darbyshire et al. | |
| D941,147 | S | 1/2022 | Wang | |
| D942,273 | S | 2/2022 | Bravman et al. | |
| D984,641 | S | 4/2023 | Fuller | |
| 2006/0081652 | A1* | 4/2006 | Press | B67D 7/005 222/189.06 |
| 2010/0078094 | A1* | 4/2010 | Trippi, Jr. | B67D 7/005 141/352 |
| 2012/0325858 | A1* | 12/2012 | Macdonald | B65D 25/48 222/189.07 |
| 2019/0106314 | A1* | 4/2019 | Shaw | B65D 85/84 |
| 2022/0194663 | A1 | 6/2022 | Taylor et al. | |

OTHER PUBLICATIONS

Polisport 20L Pro Octane Rapid Fuel Can, http://web.archive.org/web/20220705085001/https://www.wscperformance.co.uk/products/polisport-201-pro-octane-rapid-fuel-can as of Jul. 5, 2022, Wayback Machine webpage accessed Feb. 22, 2023 (2 pages).

Hyuduo, Aug. 6, 2020, Amazon. com Product Post, URL:https://www.amazon.com/Strainer-Pressure-Accessories-Light-Weight-Accessory/dp/B08FCHVQPG (Year:2020).

* cited by examiner

LIQUID CONTAINERS, FILTERS, CAPS, HOSE ASSEMBLIES AND KITS

CROSS REFERENCE TO RELATED APPLICATIONS

None.

FIELD

This application relates to liquid containers, such as liquid fuel containers.

BACKGROUND

In the field of liquid fuel containers, it is often desirable to filter the liquid fuel before it is poured into a fuel tank of a vehicle, for example, to prevent unwanted particulates from fouling the fuel system, engine, or other components of the vehicle. However, there is often no convenient and easy way to filter the liquid fuel before it is poured into the fuel tank, particularly in situations such as races wherein time is critical. Also, if a filter is available, it is prone to becoming clogged with particulates. Additionally, although some containers offer some type of filtration, not only is the filter not replaceable, but the screen size of the filter is typically so large that it does not actually filter out the critical, smaller particulates that could be harmful to motors. And because there is no practical way to swap out the filter, it is impossible to switch to a smaller (e.g., lower micron) screen size that would be effective. It would be a significant advancement in the art to provide a simple, quick, and easy way to filter a liquid fuel or other liquid before it is poured into a fuel tank or other liquid repository. It would also be a significant advancement to provide a filter that is easily replaceable if it becomes clogged with particulates or if a different screen size is needed.

SUMMARY

In some embodiments, a container may include a generally hollow body configured for holding a liquid and including a spout. A spout cap may be configured for removable engagement with the spout. The spout cap may include an inner boss and an outer boss in fluid communication with the inner boss. The inner boss may include an annular skirt disposed within an interior space of the spout cap. The outer boss may be configured to receive a connector of a hose assembly. A filter may have a connecting portion configured for removable insertion into the inner boss. The filter and the spout cap may form a fluid flow path from the body through the spout.

In some embodiments, a filter may include a connecting portion having a conduit extending therethrough and configured for removable insertion into a receptacle, and at least one mesh screen in fluid communication with the conduit, wherein the at least one mesh screen and the conduit form a fluid flow path through the filter. In some embodiments, the filter may include a base; a head; a plurality of columns connecting the base and the head; at least one mesh screen disposed in gaps between the plurality of columns, the base, and the head; a connecting portion extending from the head, the connecting portion configured for removable insertion into a receptacle; and a conduit extending through the head and the connecting portion; wherein the at least one mesh screen and the conduit form a fluid flow path through the filter. In some embodiments, the at least one mesh screen may include a substantially flat mesh screen disposed substantially perpendicular to a central axis of the conduit. In some embodiments, the filter may include a head and a plurality of arches extending from the head and joined together at a central position above the head, wherein the at least one mesh screen is disposed in gaps between the plurality of arches. In some embodiments, the filter may include a rim adjacent to the connecting portion, a base spaced apart from the rim, and a plurality of columns connecting the base and the rim, wherein the at least one mesh screen is disposed in gaps between the plurality of columns, the base, and the rim, and wherein the conduit extends through the rim and the connecting portion. In some embodiments, the filter may have a screen with a conical shape, which may or may not have one or more support elements attached thereto.

In some embodiments, a kit may include a container having a generally hollow body configured for holding a liquid and including a spout and a vent. The kit may include a spout cap configured for removable engagement with the spout, the spout cap including an inner boss and an outer boss in fluid communication with the inner boss, the inner boss being disposed within an interior space of the spout cap, the outer boss configured to receive a connector of a hose assembly. The kit may include a vent cap removably engaged with the vent. The kit may include one or more filters each having a connecting portion configured for removable insertion into the inner boss, and one or more hose assemblies each having a connector configured for removable engagement with the outer boss. When a selected filter from the one or more filters is installed in the inner boss and a selected hose assembly from the one or more hose assemblies is installed in the outer boss, the selected filter, the spout cap, and the selected hose assembly form a fluid flow path from the body through the selected filter, the spout cap, and the selected hose assembly.

In some embodiments, a container may include a generally hollow body configured for holding a liquid and including a spout, a vent, and a handle. The handle may have a front end and a rear end. The spout may be disposed in front of the handle, and the vent may be disposed at or proximate to the rear end of the handle. In some embodiments, the vent may be substantially aligned with a central axis of the handle. In some embodiments, the vent may face rearward from the handle. In some embodiments, a vent cap may be removably engaged with the vent. In some embodiments, the handle and the vent cap may be configured for one-handed grasping of the handle and manipulation of the vent cap.

In some embodiments, a spout cap is provided for removable engagement with a spout of a container. The spout cap may include an upper portion; an outer skirt depending downward from the upper portion and including internal threads configured for threaded engagement with external threads on the spout; an inner boss depending downward from the upper portion and including an annular skirt disposed within an interior space of the spout cap, the inner boss configured for receiving a connecting portion of a filter; and an outer boss depending upward from the upper portion and configured to receive a connector of a hose assembly, the outer boss being in fluid communication with the inner boss.

DETAILED DESCRIPTION

The following terms as used herein should be understood to have the indicated meanings:

When an item is introduced by "a" or "an," it should be understood to mean one or more of that item.

"Comprises" means includes but is not limited to.

"Comprising" means including but not limited to.

"Having" means including but not limited to.

Figure 1:
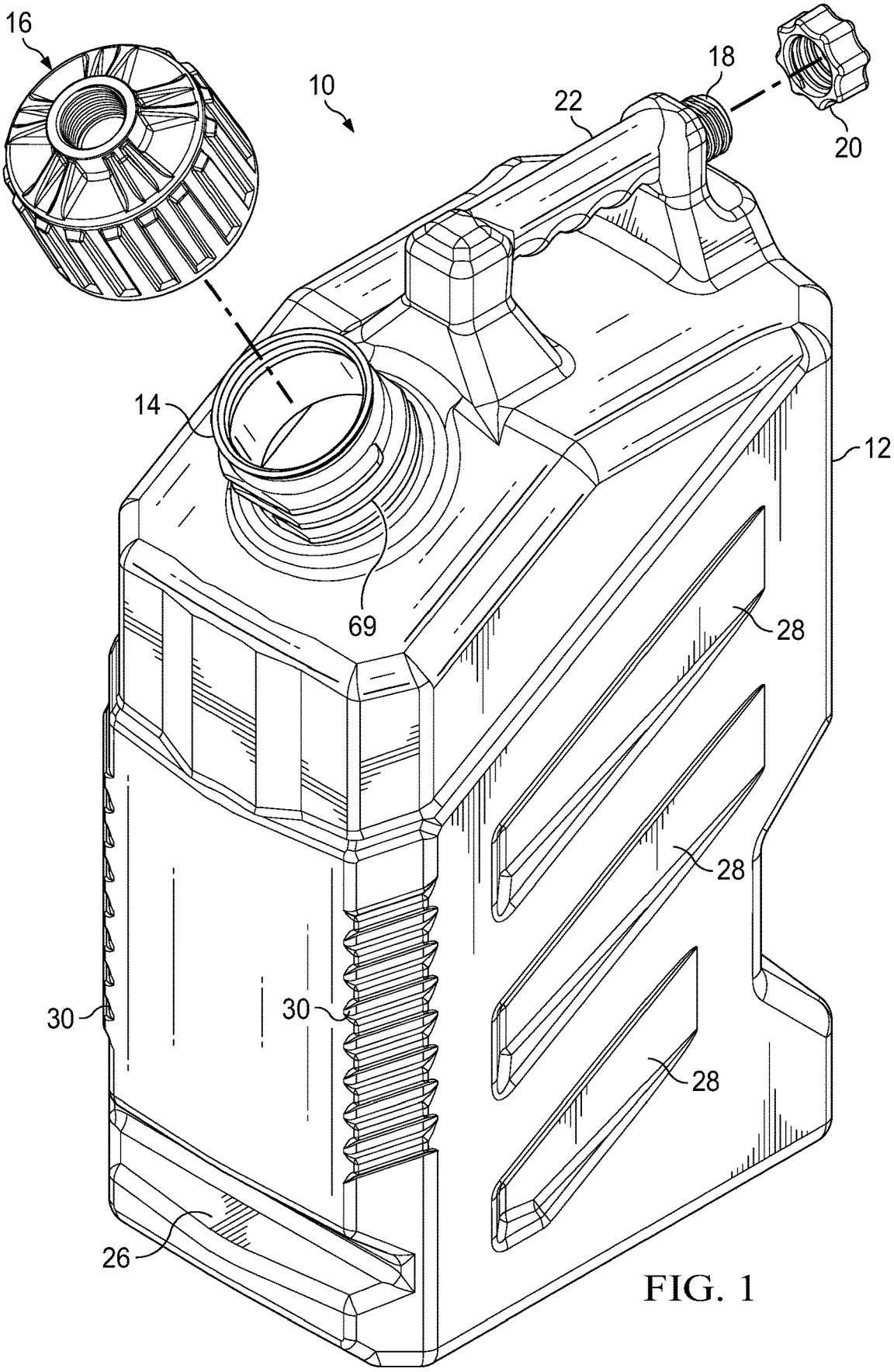
FIG. 1 is a perspective view of a liquid fuel container with a spout cap and a vent cap shown in exploded positions.

As shown in FIG. 1, a liquid fuel container 10 may have a generally hollow body 12 adapted for holding liquid fuel. Container 10 may include a spout 14 and a spout cap 16 configured for removable engagement with the spout. For example, spout 14 may have external threads configured for threaded engagement with internal threads of spout cap 16. Container 10 may also have a vent 18 and a vent cap 20 configured for removable engagement with the vent. For example, vent 18 may have external threads configured for threaded engagement with internal threads of vent cap 20. To facilitate handling and use, container 10 may include a top handle 22, a rear handle 24 (see FIG. 6), and a finger hold indentation 26. Of course, other handle or grip arrangements may be used, if desired. As shown, spout 14 may be disposed in front of handle 22, and vent 18 may be disposed at or proximate to the rear end of handle 22. In some embodiments, vent 18 may be substantially aligned with a central axis of handle 22, and vent 18 may face rearward from handle 22. In some embodiments, the walls of container 10 may include one or more recesses 28 that may serve as wall stiffeners as well as gripping aids. Similarly, some embodiments may include one or more ridges 30 along one or more edges of container 10, which again may help stiffen the walls and aid in gripping the container.

Figure 2:
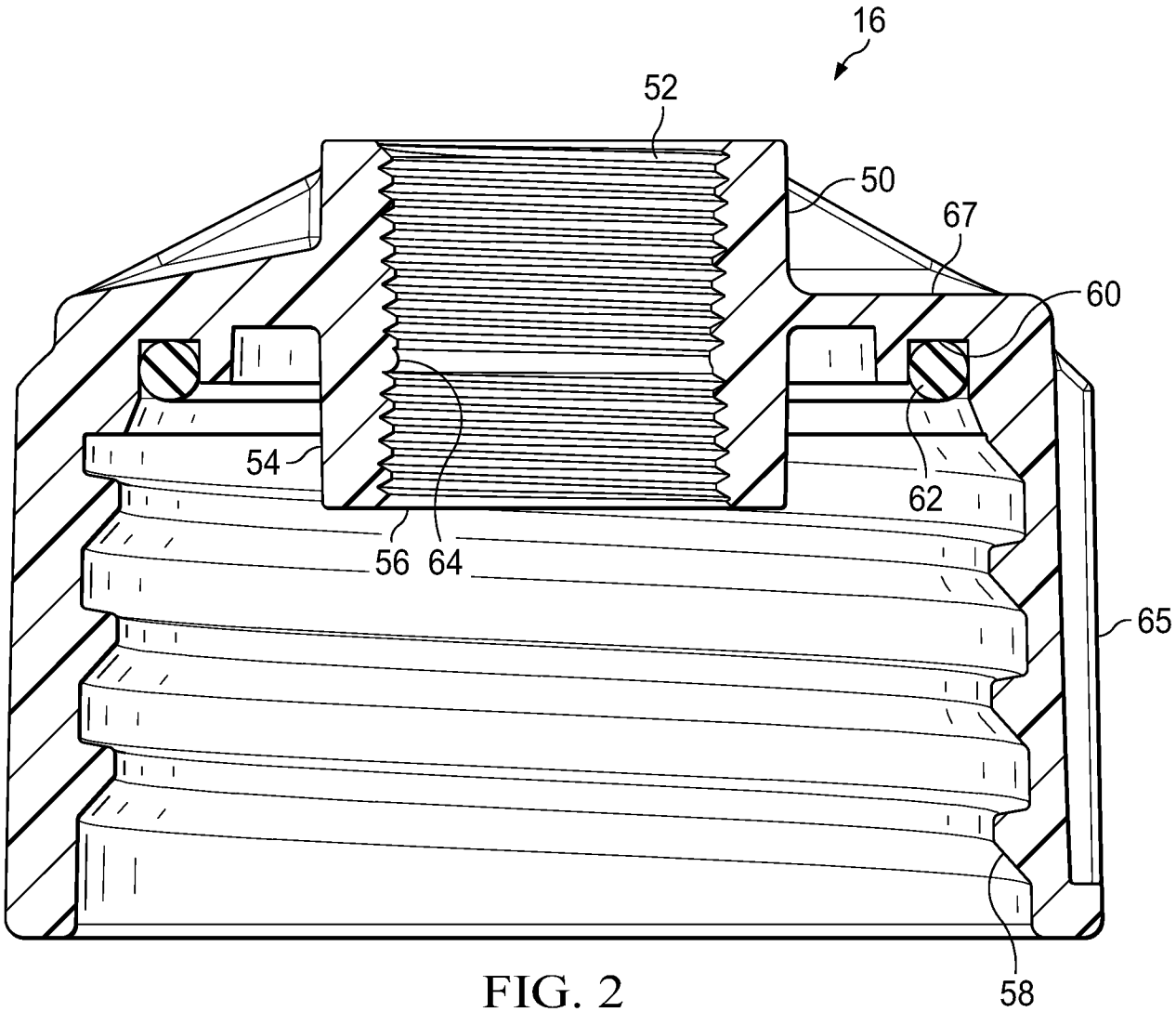
FIG. 2 is a cross-sectional view of the spout cap of FIG. 1.
Figure 5:
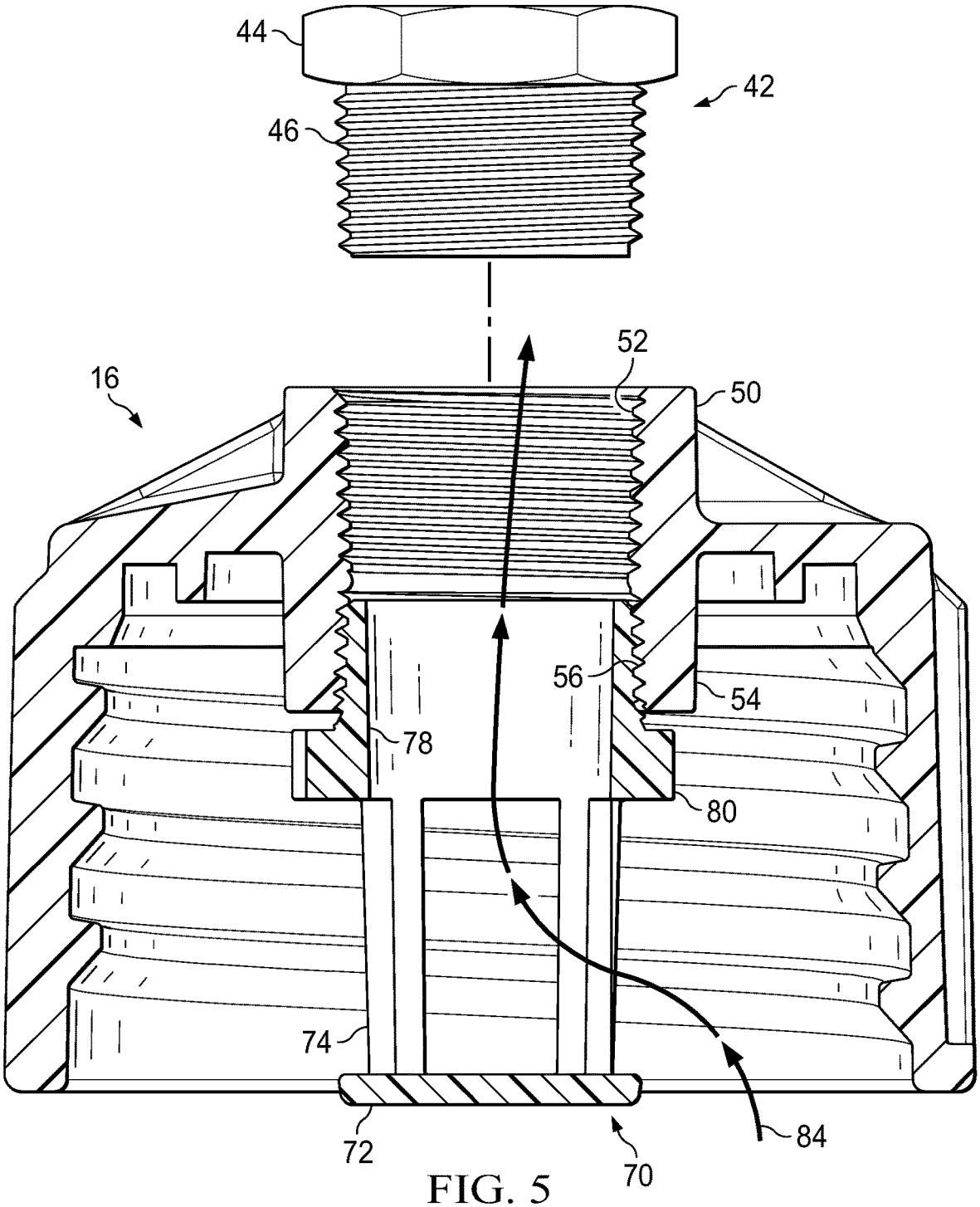
FIG. 5 is a cross-sectional view of the spout cap and fuel filter of FIG. 3 showing the fuel filter in an installed position and showing a spout plug in an exploded position. The mesh screen of the fuel filter is not shown in FIG. 5 for clarity.

Referring to FIG. 2, spout cap 16 may have an outer skirt 65 extending downward from an upper portion 67, the outer skirt 65 including internal threads 58 configured for threaded engagement with external threads 69 on spout 14 (see FIG. 1). Spout cap 16 may have an outer boss 50 and an inner boss 54 configured with threads 52 and 56, respectively. Threads 52 and 56 may be separated by an unthreaded portion 64 that may or may not serve as a stop. In some embodiments, threads 52 and 56 may be opposing threads oriented in opposite thread directions (e.g., threads 52 may be right-handed or left-handed from the exterior, and threads 56 may be right-handed or left-handed from the interior), or threads 52 and 56 may be oriented in the same thread direction. As shown, outer boss 50 may depend upward from upper portion 67, and inner boss 54 may be in the form of an annular skirt projecting downward from upper portion 67 such that inner boss 54 is disposed within an interior space of spout cap 16. Threads 52 may be configured for fluid-tight threaded engagement with threads 33 of a connector 34 of hose assembly 32 as described further below. Threads 56 may be configured for fluid-tight threaded engagement with threads 82 of a filter 70 as described further below. Spout cap 16 may also include an O-ring 62 or flat gasket seated in an annular groove 60 in upper portion 67 for fluid-tight engagement with the rim of spout 14. Of course, any suitable fluid-tight sealing arrangement may be used. In some embodiments, as shown in FIG. 5, a plug 42 having a suitable head (e.g., hex head 44) and threads 46 may be screwed into the threads 52 of outer boss 50 to close spout 14 when the hose assembly 32 is not in use. The threads described herein may be configured for fluid-tight sealing engagement of the various components. For example, in some embodiments, the threads may be NPT standard pipe threads or other suitable threads.

Figure 3:
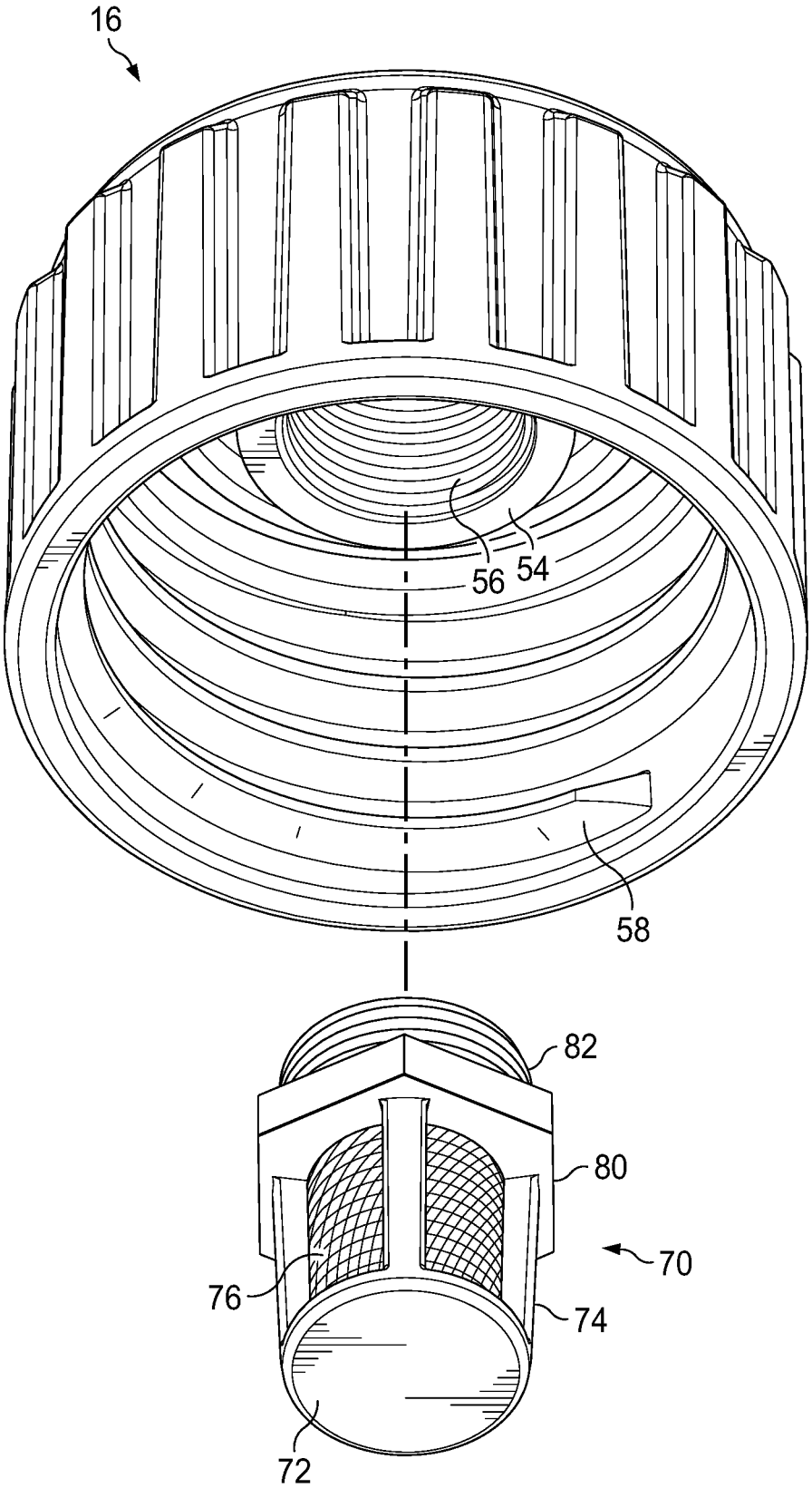
FIG. 3 is an exploded perspective view of the spout cap of FIG. 1 and a fuel filter.

As shown in FIG. 3, filter 70 may have a base 72 and a plurality of columns 74 extending between base 72 and a hex head 80. A mesh screen 76 (or a plurality of mesh screens) may be disposed in the gaps between the columns 74 to filter out particulates from the liquid as it is being poured from container 10 to prevent the particulates from entering the repository into which the liquid is poured (e.g., a fuel tank of a vehicle). For example, a suitable mesh screen 76 may be inter-molded with or attached to the columns 74, hex head 80, and/or base 72. The mesh size of mesh screen 76 may be selected to filter a desired size range of particulates and to achieve a desired flow rate when liquid is poured from container 10. Hex head 80 may be used to manually grasp filter 70 and screw it into inner boss 54. As shown in FIG. 5, filter 70 thus forms part of a fluid flow path 84 from the interior of container 10 through mesh screen 76 and conduit 78 of filter 70, and the fluid continues outward through outer boss 50 of spout cap 16 and through the hose assembly 32. Filter 70 is thus protected inside container 10 and stays clean and out of the way, and no extra housing is needed to protect the filter.

Figure 4:
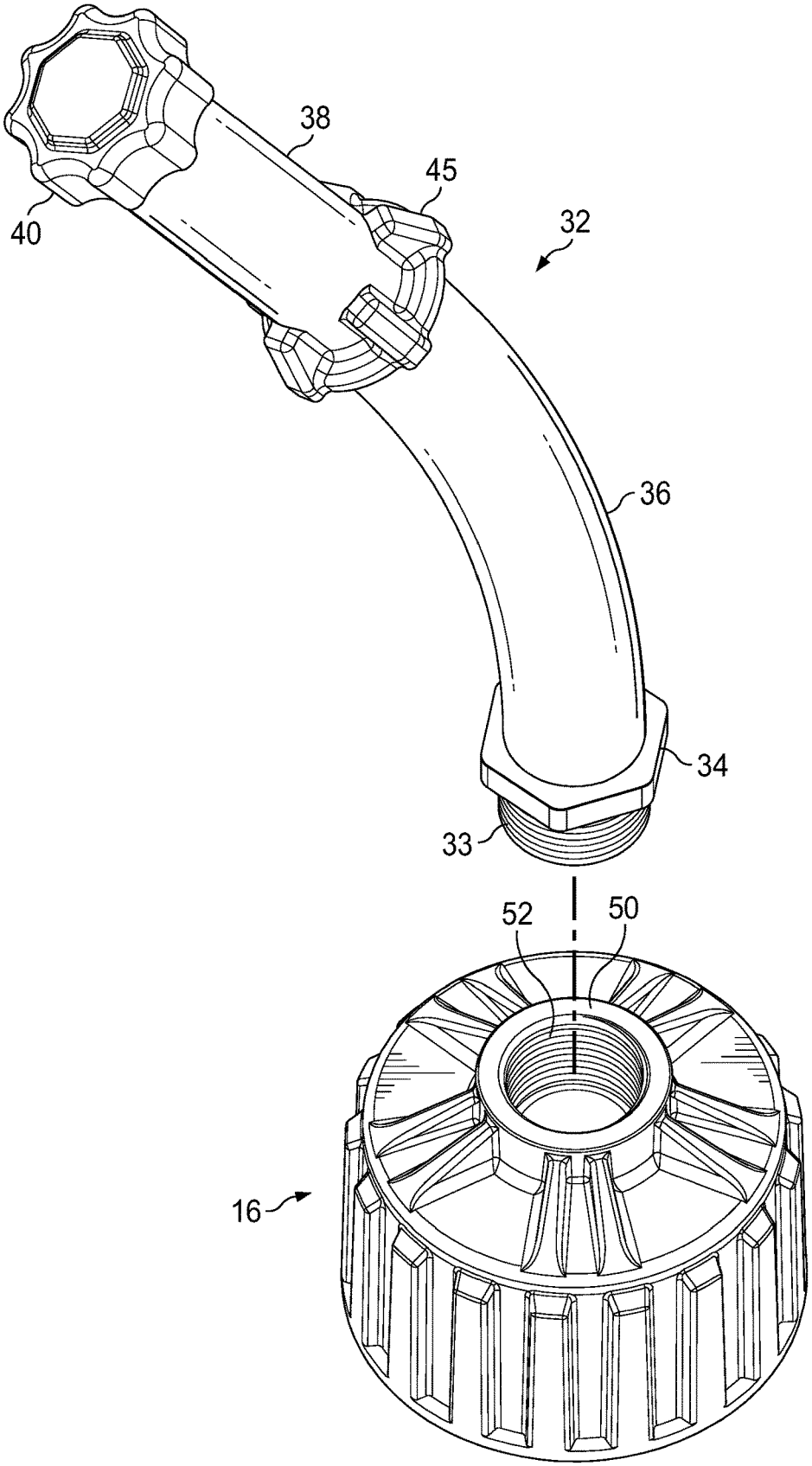
FIG. 4 is an exploded perspective view of the spout cap of FIG. 1 and a hose assembly.

As shown in FIG. 4, the hose assembly 32 may include a hose connector 34 configured for threaded, fluid-tight engagement (e.g., via NPT standard pipe threads or other suitable threads 33) with threads 52 of outer boss 50 of spout cap 16. A hose 36 may extend from hose connector 34 to a nozzle 38. In some embodiments, nozzle 38 may have a threaded end fitting 35 (see FIG. 6) configured for accepting a threaded hose cap 40 when hose assembly 32 is not in use. In some embodiments, hose cap 40 and vent cap 20 may be interchangeable. Of course, other suitable hose assemblies may be used.

Figure 7:
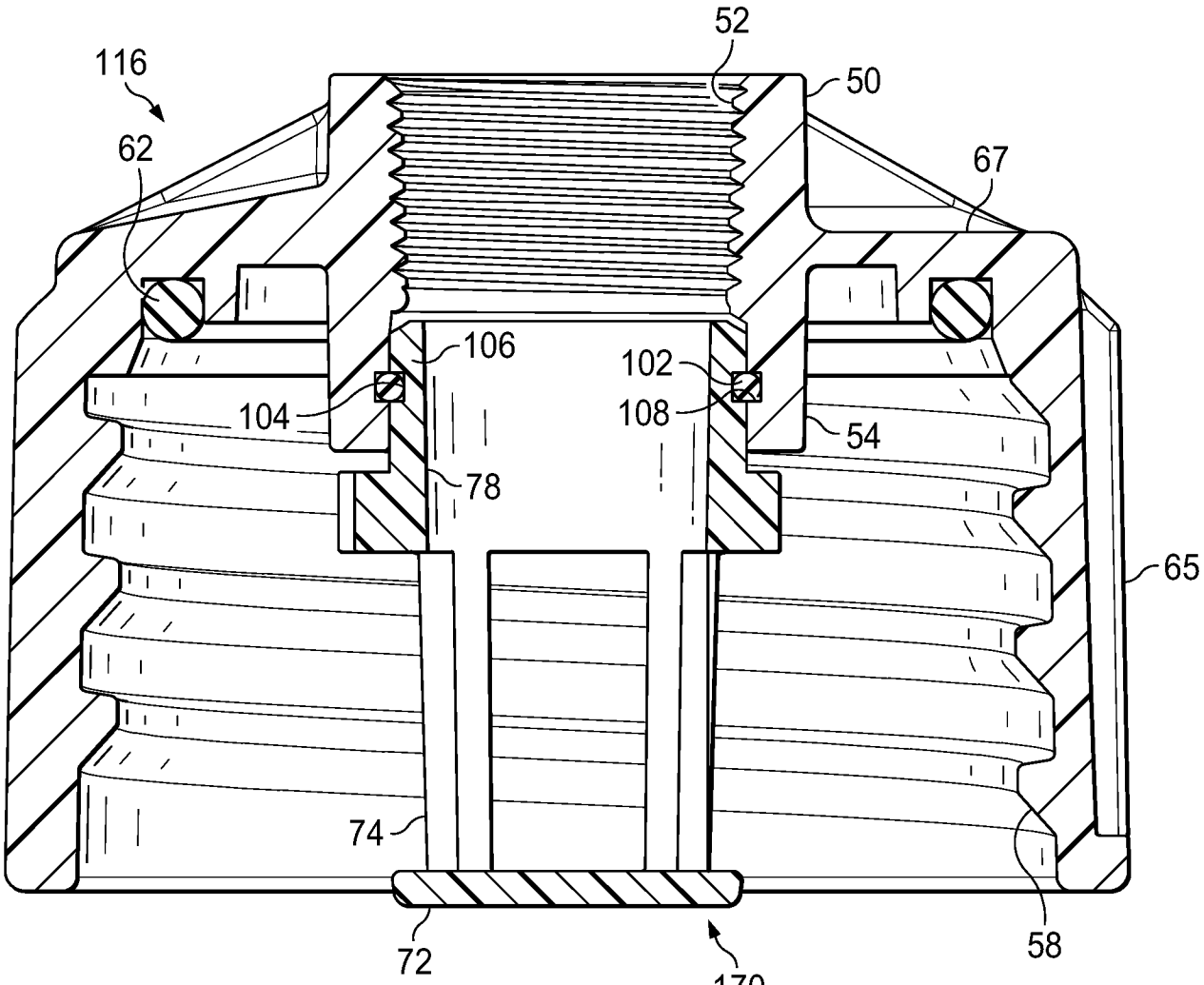
FIG. 7 is a cross-sectional view of another spout cap and fuel filter.

Another embodiment of a spout cap 116 and filter 170 is shown in FIG. 7. In this embodiment, spout cap 116 is similar to spout cap 16 described above except that inner boss 54 has a smooth cylindrical internal bore with a groove 108 rather than threads 56. Filter 170 is similar to filter 70 described above except that, rather than threads 82 on the connecting portion of filter 70, the connecting portion of filter 170 has a smooth cylindrical shank 106 with a groove 104 in which an O-ring 102 is disposed. O-ring 102 is configured to snap into groove 108 and provide a liquid-tight seal between filter 170 and spout cap 116 when filter 170 is pressed into inner boss 54. Filter 170 may be pulled and removed from inner boss 54 for cleaning or replacement. Of course, other sealing arrangements for the filter and spout cap may be employed if desired.

Figure 6:
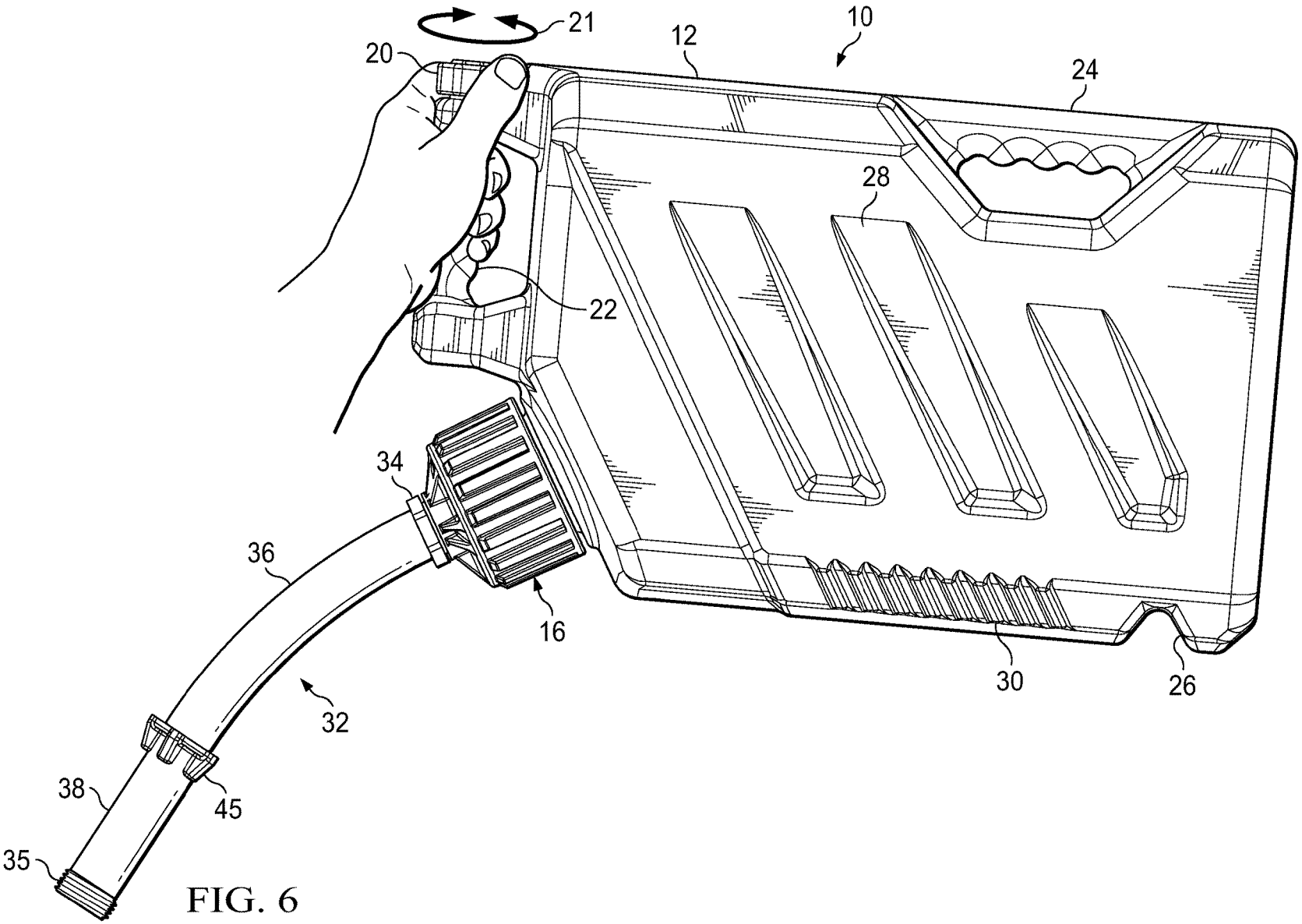
FIG. 6 is a side elevational view of the fuel container, spout cap, and vent cap of FIG. 1 with the hose assembly of FIG. 4 coupled to the spout cap and illustrating manual operation of the vent cap.

As illustrated in FIG. 6, with hose assembly 32 installed in outer boss 50 of spout cap 16 as shown and the hose cap 40 removed, nozzle 38 of hose assembly 32 may be inserted into an opening of a desired repository (e.g., a fuel tank of a vehicle), and container 10 may be tilted over from its upright position to pour liquid from container 10 into the repository. In some embodiments, hose assembly 32 may include a stop, such as tapered stop 45 shown in FIG. 4, configured to engage with the opening of the repository and help to properly position nozzle 38 in the opening. The stop 45 may also transfer some of the weight of the liquid-filled container 10 away from the user, allowing it to rest slightly on the repository. In some embodiments, a user may grasp container 10 in a "backwards" fashion as shown in FIG. 6 so that the user may twistingly operate the vent cap 20 (as shown at 21) with the thumb and forefinger of the user's same hand to control the amount of venting and thus the rate of fluid flow from the container. The user may grasp the rear handle 24 or indentation 26 with the user's other hand for stability and control of the container during pouring operations. The configuration of the vent 18 and vent cap 20 as shown may mitigate against any awkward jostling of the container 10 as a user seeks to open the vent 18 once the hose 36 is inserted into the repository. With other types of containers, a user generally must awkwardly hold the container with one hand at its center of gravity in order to free up the user's other hand to open the vent. With the present container, a user may readily open the vent while firmly keeping a grasp on opposing ends of the container, which results in safer, steadier, and more controlled use of the container.

Figure 8:
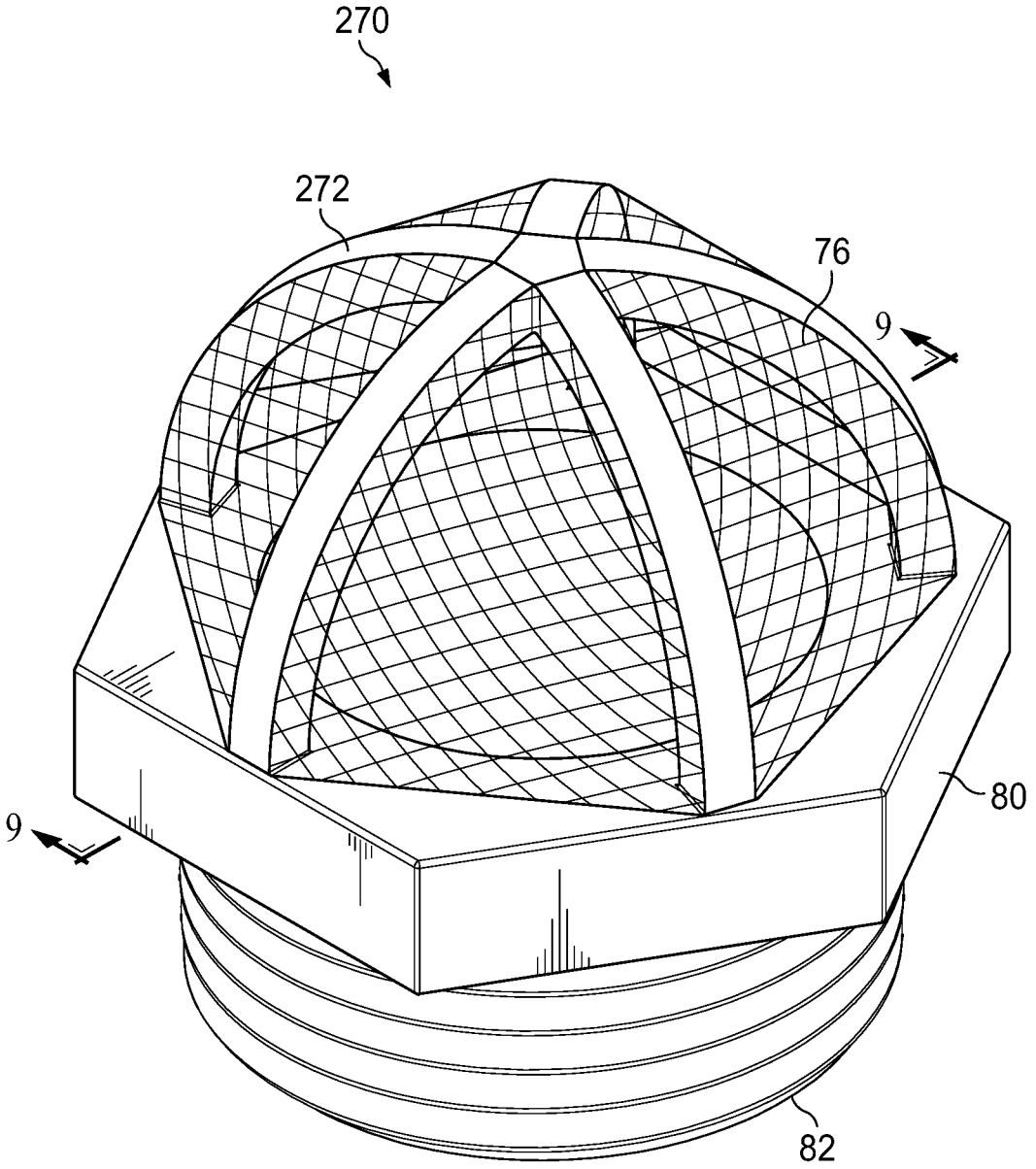
FIG. 8 is a perspective view of another filter.
Figure 9:
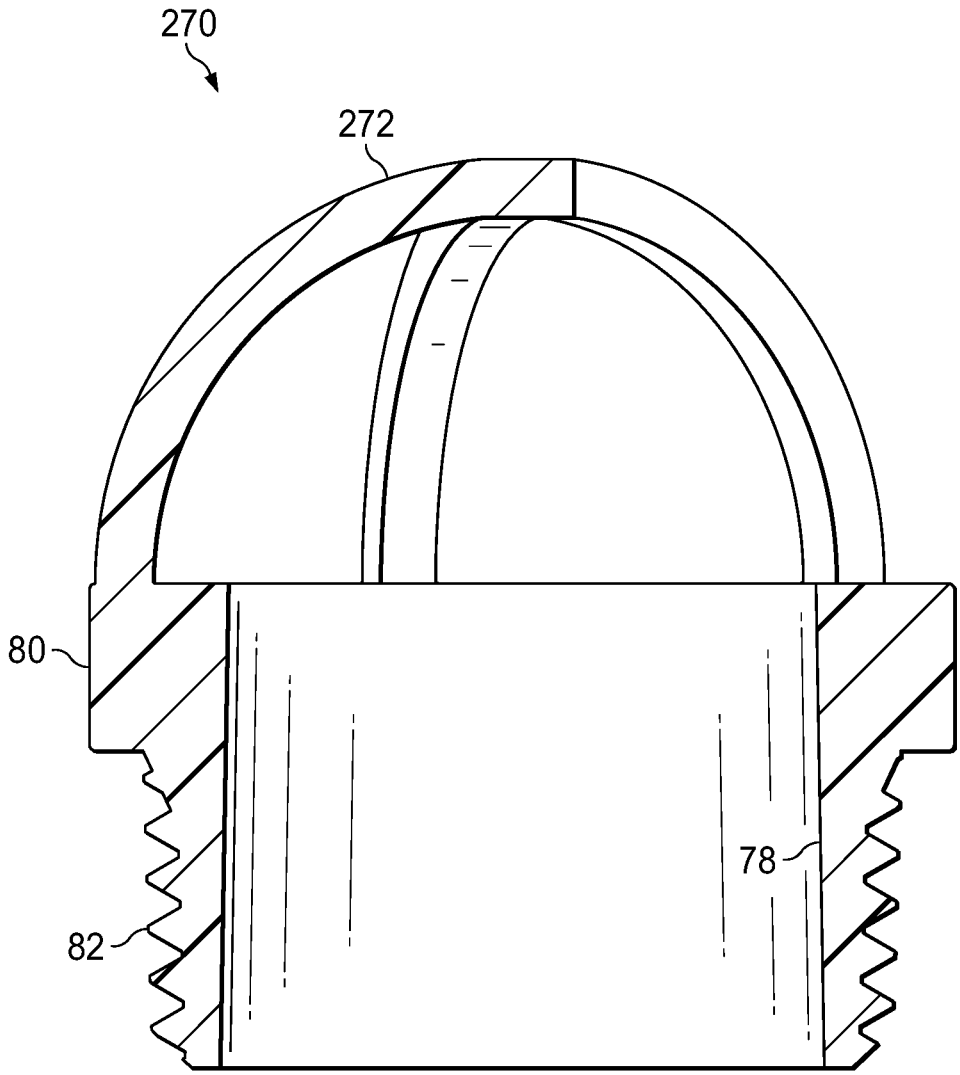
FIG. 9 is a cross-sectional view of the filter of FIG. 8.

Referring to FIGS. 8-15, other alternative filters are shown having threads 82 configured for threaded engagement with threads 56 of spout cap 16 similar to filter 70 described above. For example, as shown in FIGS. 8-9, filter 270 may have a hex head 80 and a plurality of arches 272 extending from hex head 80 and joined together at a central position above hex head 80. Similar to filter 70, a mesh screen 76 or a plurality of mesh screens (not shown in FIG. 9 for clarity) may be disposed in the gaps between the arches 272 to filter out particulates from the liquid as it is being poured from container 10 through conduit 78 to prevent the particulates from entering the repository into which the liquid is poured (e.g., a fuel tank of a vehicle). For example, a suitable mesh screen 76 may be inter-molded with or attached to the arches 272 and/or hex head 80. The mesh size of mesh screen 76 may be selected to filter a desired size range of particulates and to achieve a desired flow rate when liquid is poured from container 10. Hex head 80 may be used to manually grasp filter 270 and screw it into inner boss 54 of spout cap 16 similar to filter 70 described above.

Figure 10:
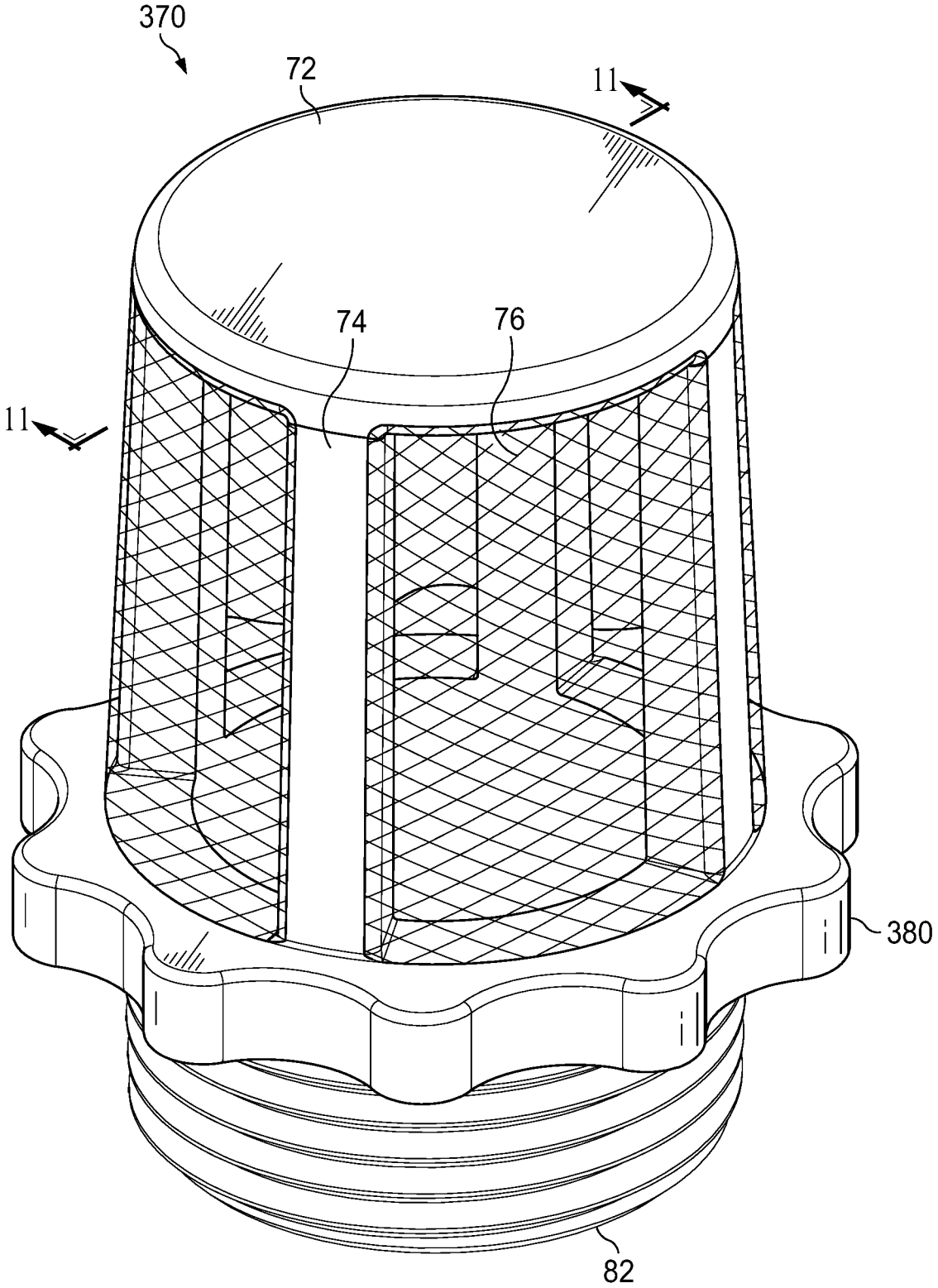
FIG. 10 is a perspective view of yet another filter.
Figure 11:
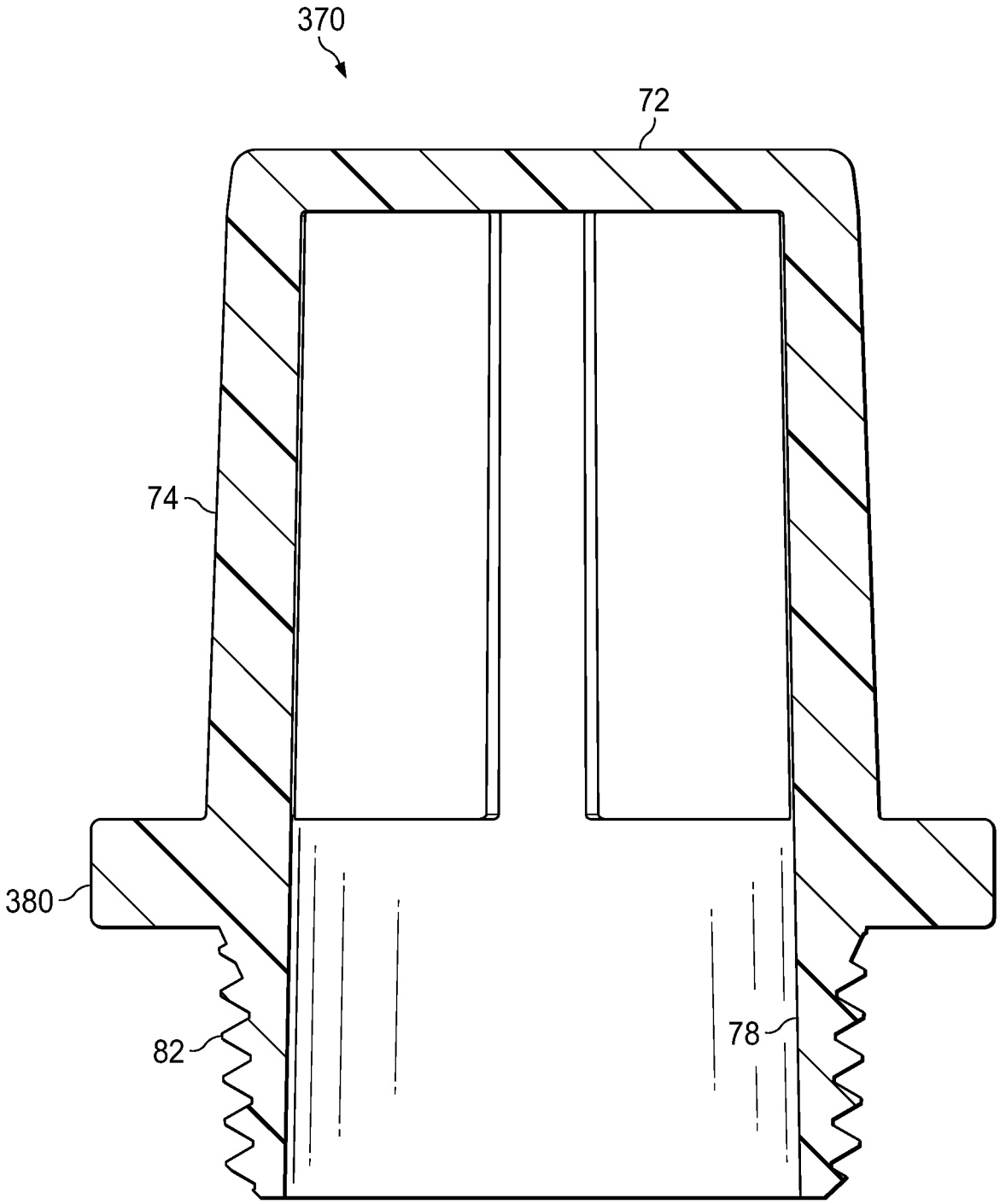
FIG. 11 is a cross-sectional view of the filter of FIG. 10.

As illustrated in FIGS. 10-11, instead of a hex head, filter 370 may have a multi-lobed head 380 for manual grasping of filter 370 to screw it into inner boss 54 of spout cap 16 via threads 82. Similar to filter 70, filter 370 has a plurality of columns 74 extending between multi-lobed head 380 and a base 72, and a mesh screen 76 or a plurality of mesh screens (not shown in FIG. 11 for clarity) may be disposed in the gaps between the columns 74 to filter out particulates from the liquid. Filter 370 has an internal conduit 78 through which liquid may flow similar to filter 70 described above. Also similar to filter 70, a suitable mesh screen 76 may be inter-molded with or attached to the columns 74, base 72, and/or multi-lobed head 380. The mesh size of mesh screen 76 may be selected to filter a desired size range of particulates and to achieve a desired flow rate when liquid is poured from container 10.

Figure 12:
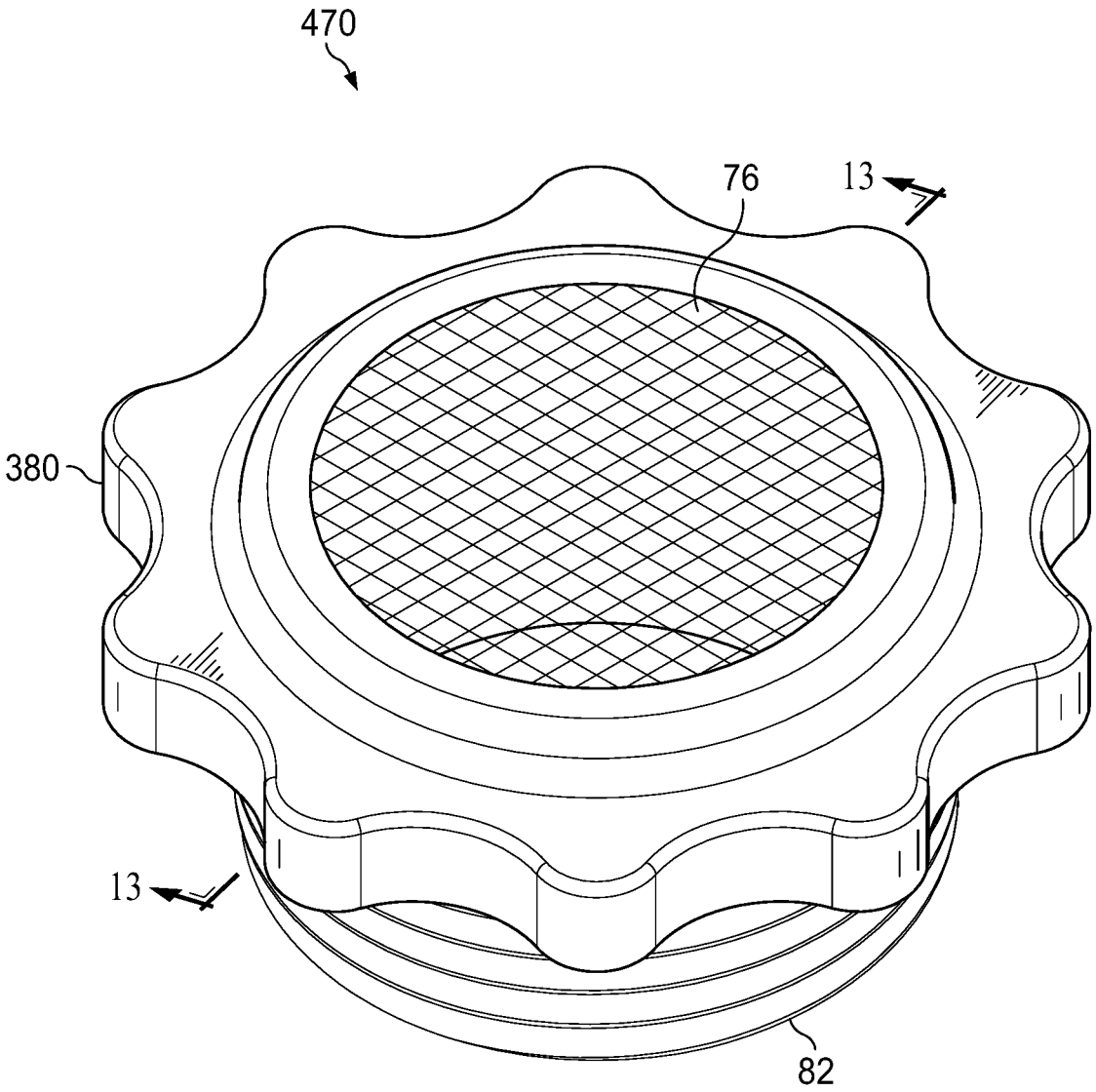
FIG. 12 is a perspective view of yet another filter.
Figure 13:
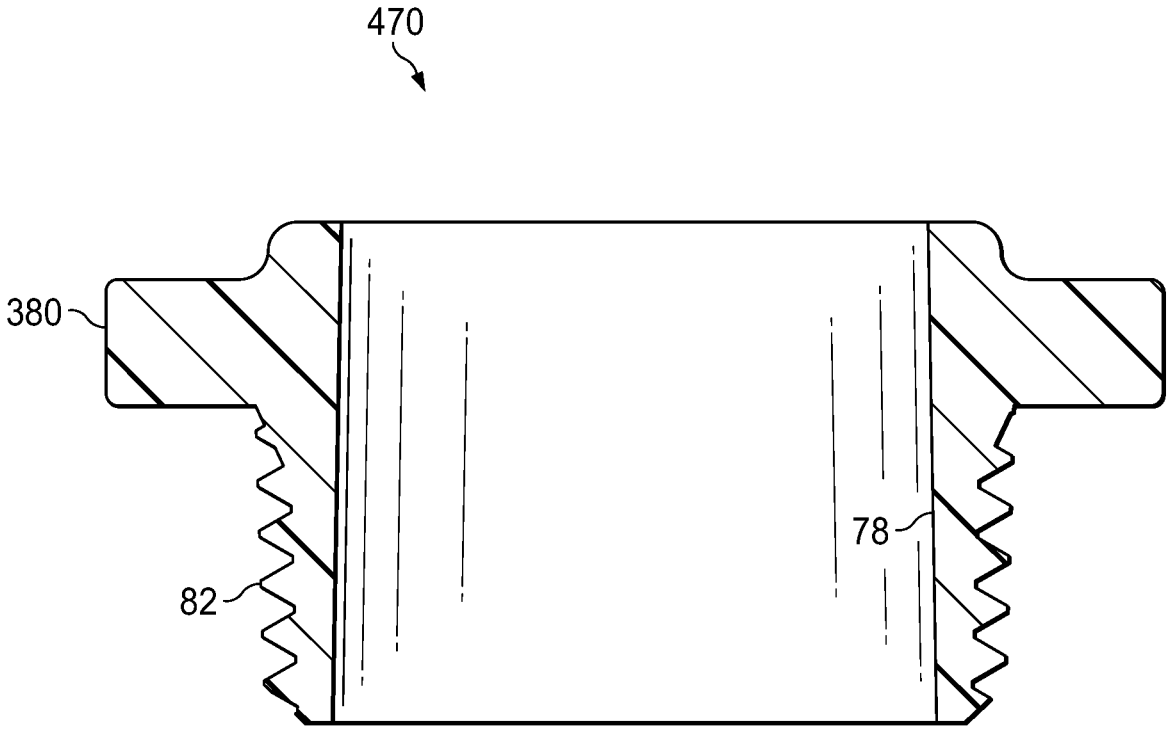
FIG. 13 is a cross-sectional view of the filter of FIG. 12.

Referring to FIGS. 12-13, another alternate filter 470 may have a multi-lobed head 380 similar to filter 370 described above, and a substantially flat mesh screen 76 may be disposed across the opening of conduit 78 (e.g., substantially perpendicular to the central axis of conduit 78) on or adjacent to the multi-lobed head 380. As with other embodiments described herein, the mesh size of mesh screen 76 may be selected to filter a desired size range of particulates and to achieve a desired flow rate when liquid is poured from container 10 through filter 470. The mesh screen 76 may be inter-molded with or attached to multi-lobed head 380 or another portion of filter 470 adjacent thereto. In some embodiments, filter 470 may have a hex head rather than a multi-lobed head, or a combination thereof.

Figure 14:
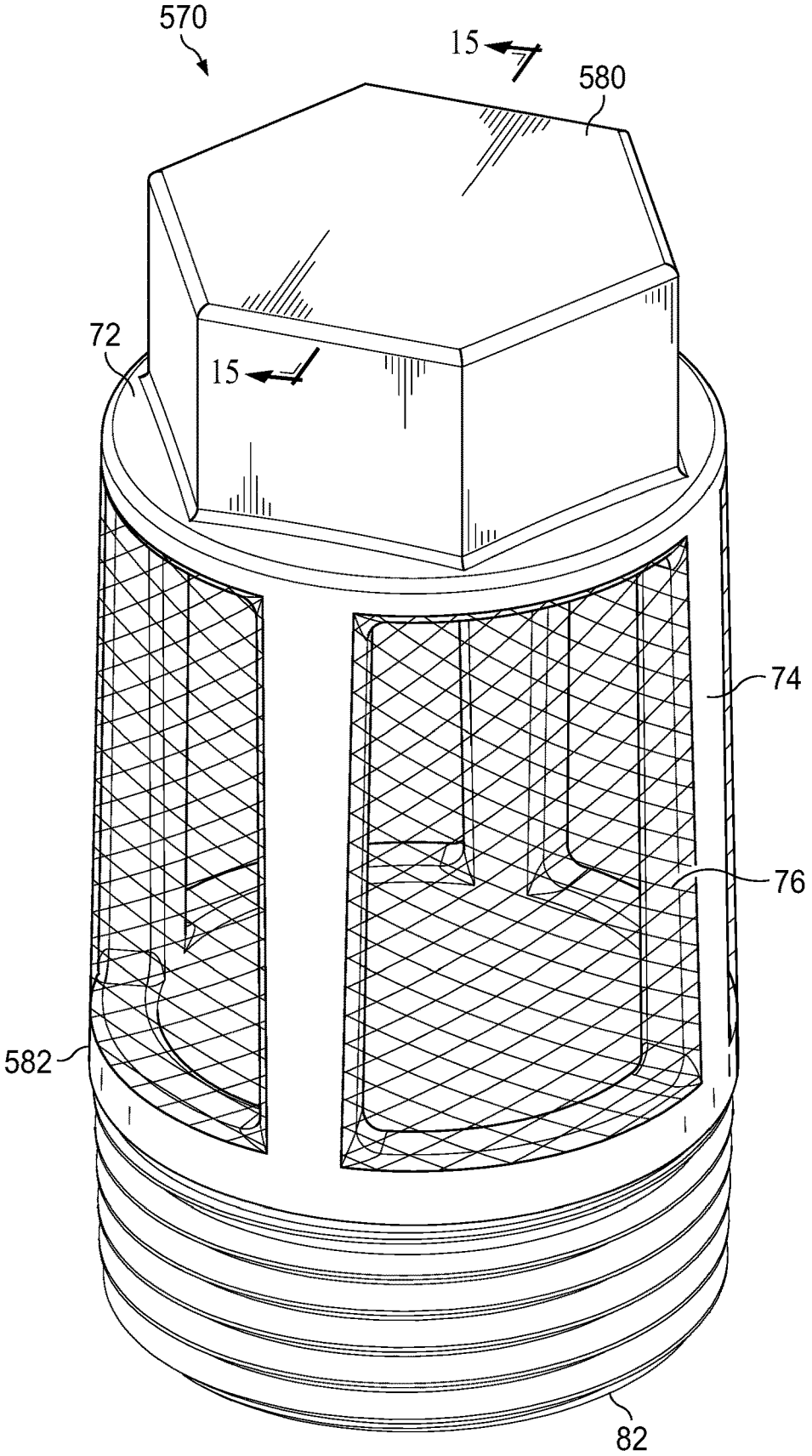
FIG. 14 is a perspective view of yet another filter.
Figure 15:
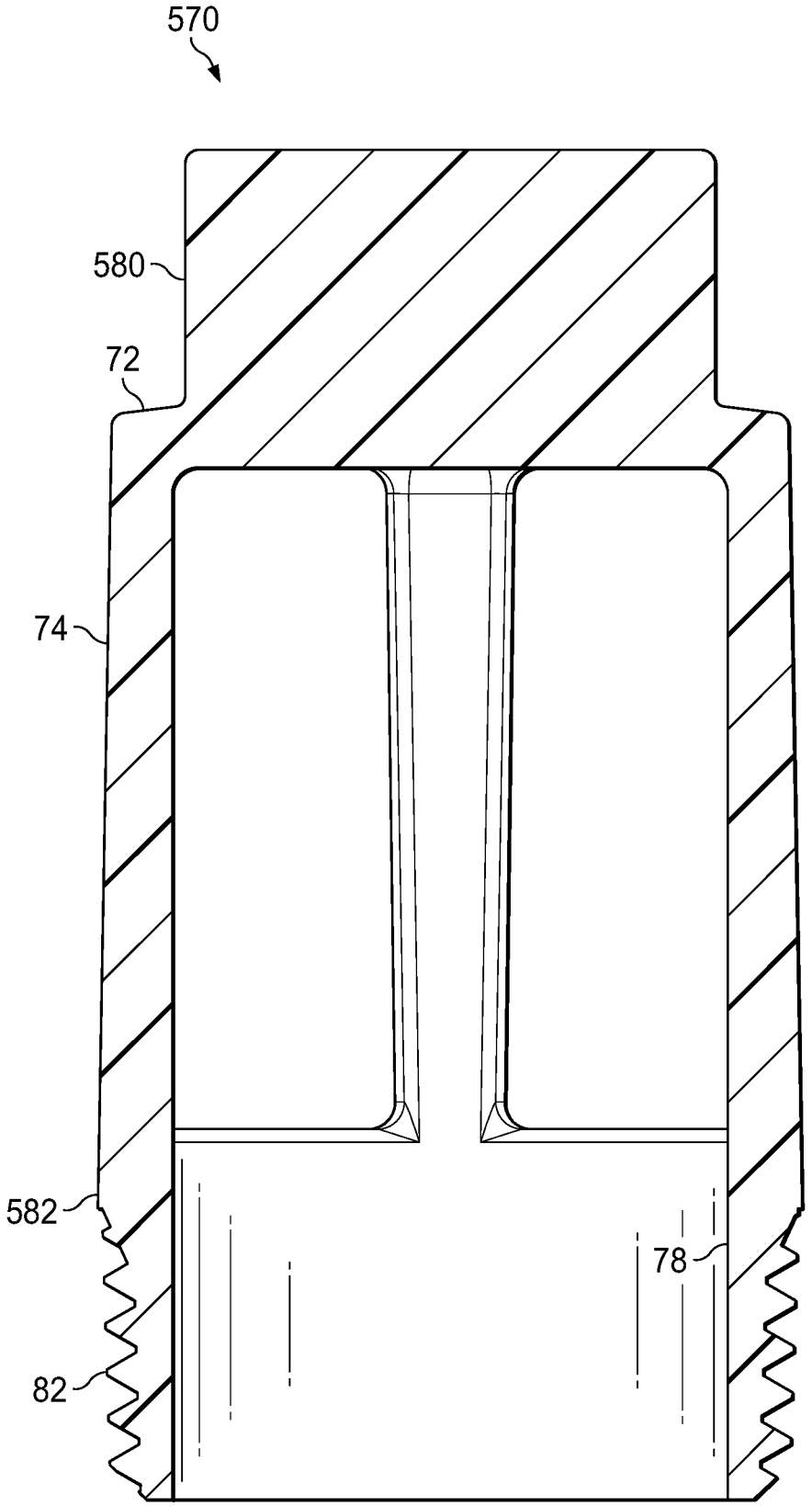
FIG. 15 is a cross-sectional view of the filter of FIG. 14.

Referring to FIGS. 14-15, another alternative filter 570 may have a rim 582 adjacent threads 82, a base 72 spaced from rim 582, and a plurality of columns 74 extending between rim 582 and base 72. A hex head 580 may extend from base 72 to facilitate manual grasping of filter 570. Filter 570 has an internal conduit 78 through which liquid may flow similar to other embodiments described above. Also similar to other embodiments, a mesh screen 76 or a plurality of mesh screens (not shown in FIG. 15 for clarity) may be disposed in the gaps between the columns 74 to filter out particulates from the liquid. Mesh screen 76 may be inter-molded with or attached to the columns 74, base 72, and/or rim 582. The mesh size of mesh screen 76 may be selected to filter a desired size range of particulates and to achieve a desired flow rate when liquid is poured from container 10.

Alternatively, instead of threads 82, each of filters 270, 370, 470, 570 may be provided with a smooth cylindrical shank 106 with a groove 104 in which an O-ring 102 is disposed as described above for filter 170 and thus configured for a press-fit, removable engagement with inner boss 54 of spout cap 116 (see FIG. 7). In such embodiments, O-ring 102 is configured to snap into groove 108 and provide a liquid-tight seal between filter 270, 370, 470, 570 and spout cap 116, and filter 270, 370, 470, 570 may be pulled and removed from inner boss 54 for cleaning or replacement.

In some embodiments, additional advantages may be realized if the threads of filter 70 and connector 34 of hose assembly 32 are the same or compatible. For example, if filter 70 is not installed in inner boss 54, the hose assembly 32 (via connector 34) may be screwed into inner boss 54 before spout cap 16 is screwed onto spout 14, and the hose assembly 32 may be suitably sized and disposed inside container 10, such as during initial shipment or storage, for example. If desired, the filter 70 may also be disposed inside container 10 (e.g., in a loose, uninstalled condition) and then installed in inner boss 54 when ready to use. Alternatively, filter 70 may be installed in spout cap 16, and hose assembly 32 may be disposed inside container 10 in a loose, uninstalled condition; or, both filter 70 and hose assembly 32 may be disposed inside container 10 in a loose, uninstalled condition awaiting installation and use as described herein.

In some embodiments, a container 10 may be provided as a kit (e.g., a fueling kit) that includes one or more hose assemblies 32, one or more filters 70, and one or more plugs 42 in addition to container 10, spout cap 16, and vent cap 20. For example, a kit may include a plurality of hose assemblies 32 having different sizes and flow rates and a plurality of filters 70 having different mesh sizes and flow rates. A user may select a particular hose assembly 32 and a particular filter 70 from among the respective pluralities of hose assemblies and filters to achieve a desired flow rate and degree of filtration, depending on the user's needs.

Although the containers and other components illustrated herein have been described primarily for use as fuel containers and fueling assemblies, persons of ordinary skill in the art will appreciate that such containers and components may also be used for other liquids, such as oil, water, solvents, chemicals, beverages, and other liquid compositions. The containers and other components described herein may be made of suitable materials, depending on the particular liquids involved. For example, in some embodiments designed for liquid fuels, the containers and other components illustrated herein may be made of suitable plastic, such as high density polyethylene (HDPE). The hose 36 may be any suitable hose material, such as PVC with dibutyl and dioctyl phthalate plasticizers, polyurethane, fluorosilicone, or PVDF, for example. Although threaded connections have been described for the various connections between and among the filters, spout caps, containers, spouts, and hose assemblies described herein, other suitable connections, such as quick connect fittings, for example, may also be used to connect those components.

Although the structures disclosed herein and some of their advantages have been described in detail, it should be understood that various changes, substitutions, and alterations may be made herein without departing from the invention as defined by the appended claims and their legal equivalents. For example, among other things, any feature described for one embodiment may be used in any other embodiment, and any feature described herein may be used independently or in combination with other features. Moreover, the scope of the present application is not intended to be limited to the particular embodiments described in the specification. Use of the word "include," for example, should be interpreted as the word "comprising" would be, i.e., as open-ended. As one will readily appreciate from the disclosure, processes, machines, manufactures, compositions of matter, means, methods, or steps presently existing or later to be developed that perform substantially the same function or achieve substantially the same result as the corresponding embodiments described herein may be utilized. Accordingly, the appended claims are intended to include within their scope such processes, machines, manufactures, compositions of matter, means, methods or steps.

What is claimed is:

1. A container comprising:

a generally hollow body configured for holding a liquid and including a spout;

a spout cap configured for removable engagement with the spout, the spout cap including an inner boss and an outer boss in fluid communication with the inner boss, the inner boss comprising an annular skirt disposed within an interior space of the spout cap, the outer boss configured to receive a connector of a hose assembly; and a filter having a connecting portion configured for removable insertion into the inner boss;

wherein the filter and the spout cap form a fluid flow path from the body through the spout.

2. The container of claim 1 wherein the body includes a vent, and further comprising a vent cap removably engaged with the vent.

3. The container of claim 2 wherein the body includes a handle and the vent is disposed proximate to the handle for one-handed grasping of the handle and manipulation of the vent cap.

4. The container of claim 1 further comprising a removable plug disposed in the outer boss.

5. The container of claim 1 further comprising the hose assembly with the connector disposed in the outer boss.

6. The container of claim 5 wherein the hose assembly includes a nozzle and a stop configured to engage with an opening of a fluid repository to help position the nozzle in the opening for transfer of liquid from the container to the repository.

7. The container of claim 5 wherein the hose assembly includes a hose cap configured for closing the hose assembly.

8. The container of claim 1 wherein the body includes a vent, the container further comprising:

a vent cap removably engaged with the vent;

the hose assembly with the connector disposed in the outer boss; and the hose assembly includes a removable hose cap configured for closing the hose assembly;

wherein the hose cap and the vent cap are interchangeable.

9. The container of claim 1 wherein the spout cap includes an O-ring or flat gasket seated in a groove and configured for fluid-tight engagement with a rim of the spout.

10. A container comprising:

a generally hollow body configured for holding a liquid and including a spout, a vent, and a handle;

the handle having a front end and a rear end;

wherein the spout is disposed in front of the handle; and wherein the vent is disposed at or proximate to the rear end of the handle.

11. The container of claim 10 wherein the vent is substantially aligned with a central axis of the handle.

12. The container of claim 10 wherein the vent faces rearward from the handle.

13. The container of claim 10 further comprising a vent cap removably engaged with the vent.

14. The container of claim 13 wherein the handle and the vent cap are configured for one-handed grasping of the handle and manipulation of the vent cap.

* * * * *